United States Patent [19]

Fuller et al.

[11] Patent Number: 4,817,312

[45] Date of Patent: Apr. 4, 1989

[54] USER ACTIVATED FOUNTAIN DISPLAY

[75] Inventors: Mark Fuller, Studio City; Alan S. Robinson, El Monte, both of Calif.

[73] Assignee: Wet Enterprises, Inc., Burbank, Calif.

[21] Appl. No.: 15,970

[22] Filed: Feb. 18, 1987

[51] Int. Cl.[4] ..... B05B 17/08

[52] U.S. Cl. ..... 40/439; 239/12; 239/17

[58] Field of Search ..... 239/12, 17, 18, 20, 239/24, 67, 69, DIG. 1; 84/464; 40/427, 439, 440, 441; 367/149

[56] References Cited

U.S. PATENT DOCUMENTS

| | | | |
|---|---|---|---|
| 1,977,997 | 10/1934 | Patterson | 239/17 |
| 2,868,055 | 1/1959 | Simos | 239/17 |
| 3,140,462 | 7/1964 | Hayes | 367/149 |
| 3,165,966 | 1/1965 | Pribyl | 239/18 |
| 3,530,888 | 9/1970 | Cable | 84/464 X |
| 4,376,404 | 3/1983 | Haddad | 239/18 X |
| 4,599,711 | 7/1986 | Cuomo | 367/149 X |

FOREIGN PATENT DOCUMENTS

| | | | |
|---|---|---|---|
| 1212620 | 2/1986 | U.S.S.R. | 239/18 |

*Primary Examiner*—Robert P. Swiatek

*Attorney, Agent, or Firm*—Blakely, Sokoloff, Taylor & Zafman

[57] ABSTRACT

A sound activated fountain display. A plurality of transducers are disposed on the bottom of the pool of a fountain display with the fountain being normally off. Whenever a coin is tossed into the fountain's pool, the sound waves generated by the coin are received by the transducers, activating the fountain display. By gating the responses of the various transducers, the area of the pool in which the coin was tossed may be identified. In this manner, the display may be caused to be directed to that area of the pool, customizing the display for that particular viewer. If desired, the fountain display may be in a central pool with separate "satellite" coin pools surrounding the fountain and for activating the fountain display.

21 Claims, 2 Drawing Sheets

USER ACTIVATED FOUNTAIN DISPLAY

BACKGROUND OF THE INVENTION

1. FIELD OF THE INVENTION

This invention relates to the field of water fountain displays and in particular to those displays which may be activated by response to an external stimulus such as sound.

2. BACKGROUND ART

Fountains have long been used as displays for public and private use. For examples, fountains may be found in plazas, parks, museums, amusement parks, and gardens, as well as in private homes and courtyards.

Typical prior art fountain displays are either on all the time, or are controlled by a timing device for display only during certain time periods. It is desireable to provide a fountain display which is only on when there is a viewer to watch it. To that end, it is desired to have a fountain display which is normally off but may be activated by some stimulus from a person wishing to view the display. To heighten the enjoyment of the display for the viewer, the activating mechanism should be hidden from the viewer and appear to be under the control of an "unseen hand" which customizes the display for each viewer.

An ancient pasttime associated with fountains is the tossing of a coin into the fountain's pool and making a wish. However, unless such a wish is instantly granted, there is typically no way of indicating or conveying the impression that the offered coin was favorably received. Therefore, it would be desireable to have a coin activated display. In the prior art, no such coin operated fountain displays are known to exist.

Therefore, it is the object of the present invention to provide a fountain display which may be normally off but may be activated by some stimulus from a person wishing to view the display.

It is a further object of the present invention to provide a fountain which customizes the display for a particular viewer to give the impression of interaction between the viewer and the fountain.

It is yet another object of the present invention to provide a fountain display which may be activated by the tossing of a coin into the fountain's pool.

It is still another object of the present invention to provide a fountain display in which the activating mechanism is hidden from sight from the viewer.

SUMMARY OF THE PRESENT INVENTION

A sound activated fountain display is described. A plurality of transducers are disposed on the bottom of the pool of the fountain display with the fountain being normally off. Whenever a coin is tossed into the fountain's pool, the sound waves generated by the coin are received by the transducers, activating the fountain display. By gating the responses of the various transducers, the area of the pool in which the coin was tossed may be identified. In this manner, the display may be caused to be directed to that area of the pool, customizing the display for that particular viewer. If desired, the fountain display may be in a central pool with separate "satellite" coin pools surrounding the fountain and for activating the fountain display.

DETAILED DESCRIPTION OF THE PRESENT INVENTION

Figure 1:
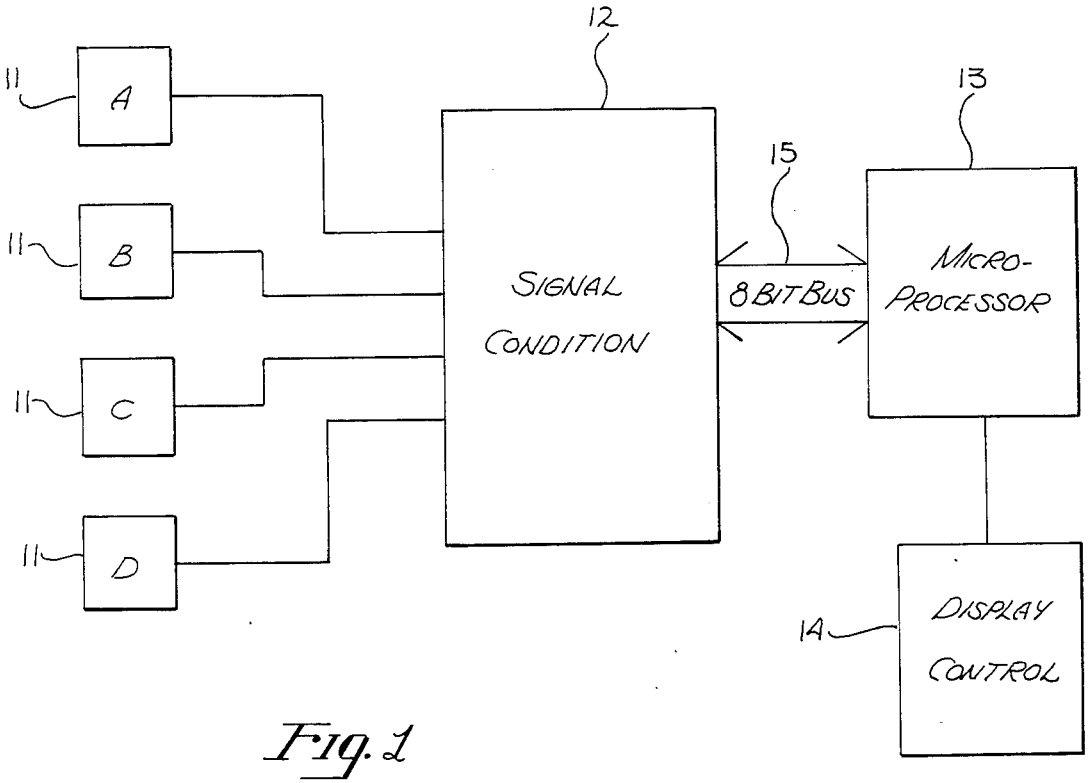
FIG. 1 is a block diagram illustrating the activation circuitry of the present invention.

FIG. 1 is a block diagram illustrating the circuitry of the present invention. One or more transducers, such as transducers 11A–11D, are disposed in a fountain pool. The output of these transducers is coupled to a signal conditioning means 12. The output of the signal conditioning means 12 is coupled through an 8 bit bus 15 to a microprocessor 13, used to determine the sequencing of signals from the transducers and control the fountain displays. Microprocessor 13 is correspondingly coupled to display control 14 which, in the preferred embodiment, consists of electromechanical switches and valves used to activate a display fountain as desired.

The transducers 11A–11D are devices for converting sound energy into an electrical signal. In the preferred embodiment of the present invention, the transducers are disposed under water and are capable of detecting sound waves traveling through the water. The output of the transducers 11 is a signal whose magnitude depends on the magnitude of the sound waves inputted to the transducer. Although a plurality of transducers (11A–11D) are shown, a single transducer can be utilized with the present invention if desired.

The output of the transducers 11 is coupled to signal conditioning means 12. The signal conditioning means 12, in the preferred embodiment of the present invention, consists of band pass filters, level detectors and analog to digital converters.

There may be a single signal conditioning means 12 for each transducer 11A–11D or a single signal conditioning means 12 for all of the transducers.

As previously mentioned, signal conditioning means 12 includes a band pass filter. The band pass filter is configured to filter out background noise which may be caused by vehicular or pedestrian traffic near the fountain or from other unwanted sound sources. Since, in the preferred embodiment of the present invention, a fountain display is to be activated by the dropping of coins into a fountain pool, the band pass filter is configured to pass frequencies in the typical range produced by coins being dropped into water. A peak detector or other level detector is then utilized to produce a digital (on/off) output dependent upon the occurrence of peaks or input signals of a sufficiently high level. The digital output of signal conditioning means 12 is coupled through an 8 bit bus 15 to a microprocessor 13.

The microprocessor 13 may be any suitable microprocessor, such as an Intel 8086 microprocessor. In the preferred embodiment of the present invention, bus 15 is a parallel bus and microprocessor 13 does a zero check of the bus inputs in a periodic fashion. For example, in the preferred embodiment of the present invention, the microprocessor checks the bus inputs at approximately 100 kilocycles. Thus, in an embodiment of the present invention in which a plurality of transducers are utilized, the microprocessor can determine which of the transducers is first activated by a coin dropped into the fountain pool by latching the first occurrence of a signal on input bus 15. If desired, after one transducer is activated, the remaining three may be disabled. In any event, it is desirable to disable the signal conditioning means or to cease sampling the input prior to activation of the fountain display since the sound of falling water in the fountain pool could continually activate the detection means.

The microprocessor 13, in addition to initiating the fountain display, also controls the length of the fountain display. The microprocessor 13 includes digital to analog converters so that the electromechanical valves and switches of display control 14 may be controlled by the microprocessor itself. In the preferred embodiment of the present invention, a number of displays may be generated by display control 14. Thus, dependent on which transducer is first activated or the order in which the transducers are activated, one of a plurality of displays is chosen by microprocessor 13 for activation. For example, it may be desirable to concentrate the fountain display near the transducer first activated, giving the person viewing display from that area a sense of interaction with the fountain.

In addition, it may be desirable to provide one of a number of randomly selected displays in response to transducer activation. In this manner, the user will be encouraged to deposit additional coins in the fountain and the unpredictability of the resulting display will add to the enjoyment of the fountain.

Figure 2:
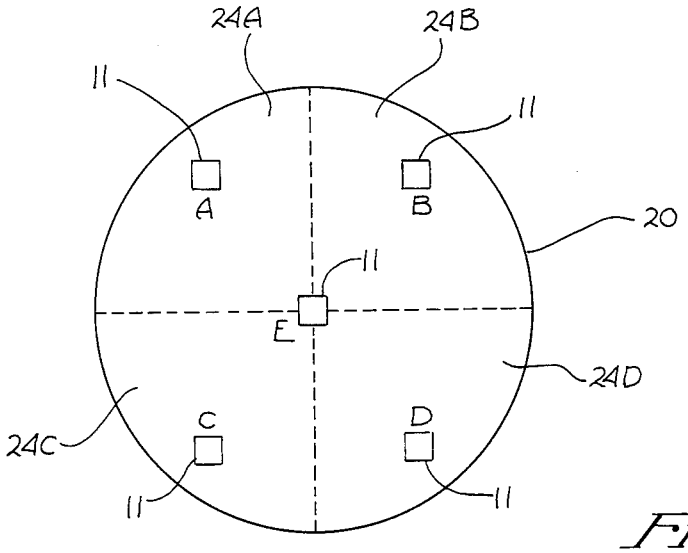
FIG. 2 is a top view of a display fountain pool illustrating the preferred embodiment of the present invention.

The preferred embodiment of the present invention is illustrated in FIG. 2. FIG. 2 is a top view of the fountain pool 20. Although the pool 20 is shown as being circularly shaped, any desired shape fountain pool may be utilized with the present invention. A plurality of transducers 11*a*–11*d* are disposed in the fountain pool. Transducers 11*a*–11*d* control pool sections 24*a*–24*d* respectively. In other words, if a sound is produced near transducer 11*c*, the resulting fountain display will be directed to section 24*c* of the pool.

The sound waves from a coin being dropped in the pool water near transducer 11*c* will activate transducer 11*c* first, before the sound waves reach the remaining transducers. The speed of sound in water is approximately 5000 feet per second. Thus, even if the transducers are only five feet apart, sound waves of a coin dropped near transducer 11*c* will reach transducer 11*c* approximately 1 millisecond before reaching any of the other transducers. This time difference is sufficiently large to determine which transducer is first activated and respond with an appropriate display. In fact, if desired, after one transducer is activated, the remaining three may be disabled prior to the sound waves reaching them.

Although in the preferred embodiment of the present invention, the display is directed to the section of the fountain pool in which the coin is tossed, other display variations may be utilized. For example, it may be desired to have a randomly selected display each time a coin is thrown into the fountain pool. In this manner, a viewer will be encouraged to toss additional coins into the pool for repeated viewings. In an alternate embodiment of the present invention a single transducer lle is utilized such as is shown in FIG. 2. With a single transducer, it is not possible to direct the display to the area of the pool in which the coin is tossed. In this embodiment, the same display may be repeated each time a coin is dropped into the fountain or a randomly selected display may be generated.

Figure 3:
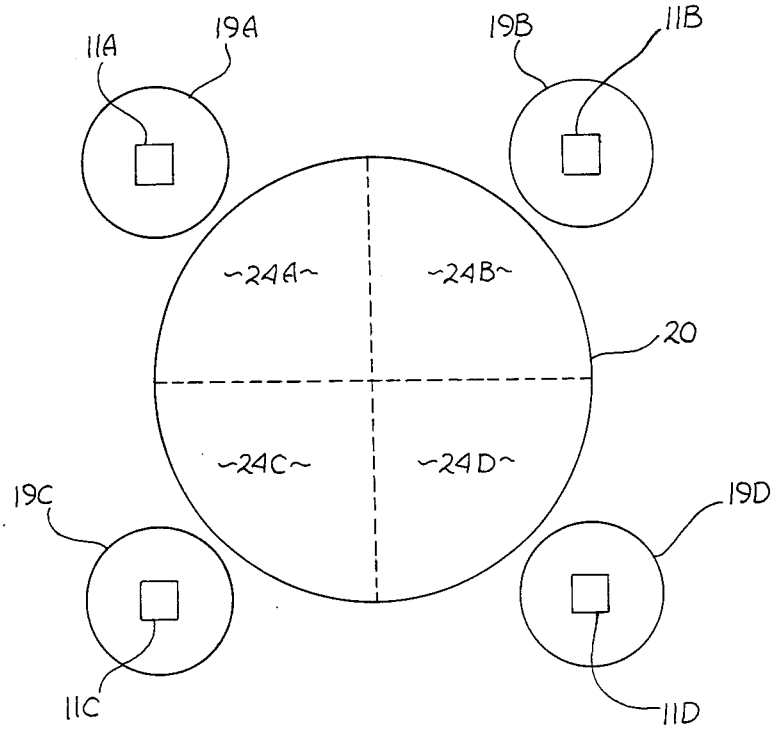
FIG. 3 is a top view of an alternate embodiment of the present invention.

A second alternate embodiment of the present invention is illustrated in FIG. 3. In this embodiment, satellite pools 19*a* –19*d* are disposed separately from fountain pool 20. Satellite pools 19*a*–19*d* correspond to fountain pool seotions 24*a*–24*d* respectively. Each satellite pool has a transducer such as transducer 11*a*–11*d* disposed within. With this arrangement, there is no need to determine which transducer was nearest a dropped coin. A coin dropped in satellite pool 19*a* will activate transducer 11*a*, causing a display to be generated in section 24*a* of fountain pool 20. Alternately, a coin dropped in any of satellite pools 19*a*–19*d* could result in a randomly generated display.

Figure 4:
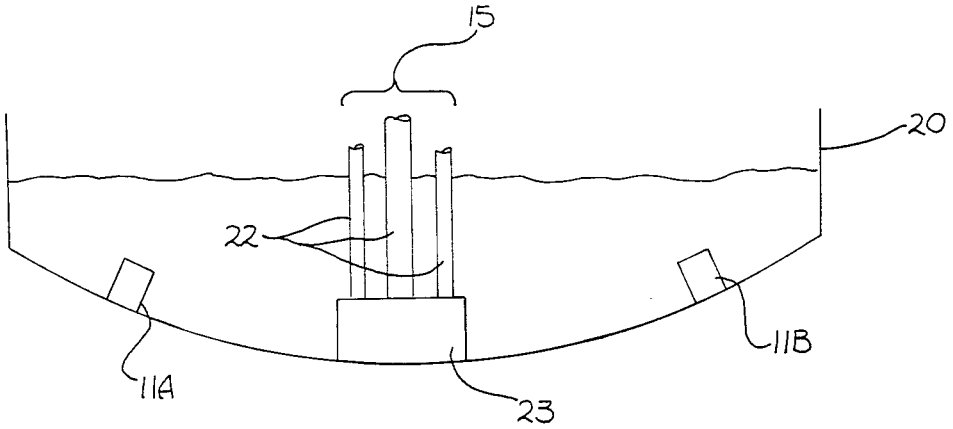
FIG. 4 is a cross sectional side view of the fountain of FIG. 2.

A cross section of the embodiment as illustrated in FIG. 2 is shown in FIG. 4. Transducers 11*a* and 11*b* are disposed on the bottom of the fountain pool 20. A fountain mechanism 23 with spray nozzles 22 of any suitable type is disposed in the fountain pool 20. The fountain assembly may be constructed so that the entire display may appear to be directed towards one section of the fountain pool. In an alternate embodiment, one or more nozzles located in the desired section of the pool may be activated in response to a coin dropped in that section.

Thus, a user activated fountain display has been described.

We claim:

1. A user activated display fountain comprising:

a fountain pool;

detection means disposed in said fountain pool for detecting underwater sound, including sound caused by a user throwing a predetermined object into said fountain pool, said detection means providing a first signal in response thereto;

signal conditioning means couples to said detection means, said signal conditioning means being a means responsive to said first signal for providing a turn-on signal when said first signal has predetermined characteristics;

fountain display control means coupled to said signal conditioning means and said display fountain, said fountain display control means being responsive to said turn-on signal to generate a display sequence in response to said turn-on signal.

2. The display fountain of claim 1 wherein said signal conditioning means comprise a band pass filter and peak detector.

3. The display fountain of claim 2 further including a plurality of sound transducers disposed in said fountain pool.

4. A user activated display fountain including a fountain pool, said display fountain comprising:

at least one sound transducer disposed beneath the surface of said fountain pool, said at least one transducer for detecting sound waves generated when a user determined object is dropped into said fountain pool and for generating a first signal;

signal conditioning means coupled to said at least one transducer, said signal conditioning means outputting a digital signal in response to said first signal;

microprocessing means coupled to said signal conditioning means, said microprocessing means for outputting one of a plurality control signals in response to said digital signal;

fountain display control means coupled to said microprocessing means, said fountain display control means for activating a fountain display in response to said control signal.

5. The display fountain of claim 4 wherein a plurality of sound transducers are disposed in said fountain pool.

6. The display fountain of claim 4 further including a plurality of sound transducers disposed in satellite pools surrounding said display fountain.

7. The display fountain of claim 4 wherein said signal conditioning means comprises a band pass filter coupled to said at least one transducer, said band pass filter for passing said sound waves generated in response to said user determined object, said signal conditioning means further including peak detecting means coupled to said band pass filter.

8. The display fountain of claim 4 wherein said fountain display control means comprises electromechanically activated valves.

9. The display fountain of claim 4 wherein said user determined object comprises at least one coin.

10. A user activated display fountain in a fountain pool comprising:

detection means in the form of a plurality of sound disposed in said fountain pool and in satellite pools surrounding said fountain pool for detecting a user generated signal, said detection means outputting a first signal when said user generated signal is detected;

signal conditioning mans coupled to said detection means, said signal conditioning means having a band pass filter and peak detector and being a means for determining the validity of said first signal and for converting said first signal to a digital signal;

microprocessing means coupled to said signal conditioning means, said microprocessing means sampling said digital signal and outputting a control signal in response to said digital signal; and, fountain display control means coupled to said microprocessing means, said fountain display control means enabled by said control signal and generating a display in response to said control signal.

11. A coin operated water display comprising:

a fountain pool;

at least one sound transducer disposed in said fountain pool below the surface of the water therein for providing a transducer signal responsive to sound transmitted through the water in said fountain pool;

signal conditioning means coupled to said at least one so transducer and responsive to the transducer signal therefrom to provide an output signal responsive to a transducer signal caused by a coin entering said fountain pool;

a fountain;

a fountain control means coupled to said signal conditioning means and said fountain and responsive to the output signal of said signal conditioning means to cause said fountain to provide a time limited water display.

12. The coin operated water display of claim 11 wherein said at least one sound transducer comprises a plurality of sound transducers and wherein said signal conditioning means and said fountain control means are responsive to the transducer signals therefrom to vary the water display in response to the approximate location the coin entered said fountain pool.

13. The coin operated water display of claim 11 wherein the water display is varied from time to time.

14. A water display comprising:

a fountain pool;

at least one sound transducer disposed in said fountain pool below the surface of the water therein for providing a transducer signal responsive to sound transmitted through the water in said fountain pool;

signal conditioning means coupled to said at least one sound transducer and responsive to the transducer signal therefrom to provide an output signal responsive to a transducer signal caused by a predetermined object entering said fountain pool;

a fountain;

a fountain control means coupled to said signal conditioning means and said fountain and responsive to the output signal of said signal conditioning means to cause said fountain to provide a time limited water display.

15. The water display of claim 14 wherein said at least one sound transducer comprises a plurality of sound transducers and wherein said signal conditioning means and said fountain control means are responsive to the transducer signals therefrom to vary the water display in response to the approximate location the object entered said fountain pool.

16. The water display of claim 14 wherein the water display is varied from time to time.

17. A method of operating a water display comprising:

(a) providing a fountain pool with at least one sound therein disposed below the water level o the pool;

(b) providing a water display;

(c) monitoring the output of the at least one sound transducer to detect a signal caused by a predetermined object entering the fountain pool; and, (d) automatically causing the water display upon detection of a sound transducer signal caused by said predetermined object entering the fountain pool.

18. The method of operating a water display of claim 17 wherein in step (d) the water display is operated for a limited time.

19. The method of claim 18 wherein the predetermined object is a coin.

20. The method of claim 18 wherein the water display is varied from operation to operation.

21. The method of claim 18 wherein in step (a), a plurality of sound transducers are disposed in the pool, each at different locations and wherein the water display is operated in a manner dependent upon the approximate location the object entered the pool.

* * * * *

UNITED STATES PATENT AND TRADEMARK OFFICE

CERTIFICATE OF CORRECTION

PATENT NO. : 4,817,312

DATED : 04/04/89

INVENTOR(S) : Fuller et al.

It is certified that error appears in the above—identified patent and that said Letters Patent is hereby corrected as shown below:

| COLUMN | LINE | DESCRIPTION |
|---|---|---|
| 04 | 07 | delete "seotions" insert --sections-- |
| 05 | 23 | after "sound" insert --transducers-- |
| 05 | 52 | delete "so" insert --sound-- |
| 06 | 39 | after "sound" insert --transducers-- |
| 06 | 40 | delete "o" insert --of-- |
| 06 | 45 | after "display" insert --to operate-- |

Signed and Sealed this

Ninth Day of October, 1990

*Attest:*

HARRY F. MANBECK, JR.

*Attesting Officer*

*Commissioner of Patents and Trademarks*